US010213033B2

(12) United States Patent
Bratsch et al.

(10) Patent No.: US 10,213,033 B2
(45) Date of Patent: Feb. 26, 2019

(54) LID OF A CONTAINER

(71) Applicant: XOLUTION GMBH, München (DE)

(72) Inventors: Christian Bratsch, Salzburg (AT); Marc Von Rettberg, München (DE)

(73) Assignee: XOLUTION GMBH, München (DE)

( * ) Notice: Subject to any disclaimer, the term of this patent is extended or adjusted under 35 U.S.C. 154(b) by 242 days.

(21) Appl. No.: 14/429,194

(22) PCT Filed: Sep. 13, 2013

(86) PCT No.: PCT/EP2013/069012
§ 371 (c)(1),
(2) Date: Mar. 18, 2015

(87) PCT Pub. No.: WO2014/044606
PCT Pub. Date: Mar. 27, 2014

(65) Prior Publication Data

US 2015/0216340 A1 Aug. 6, 2015

(30) Foreign Application Priority Data

Sep. 20, 2012 (EP) ..... 12185214

(51) Int. Cl.
*A47G 19/22* (2006.01)
*B65D 47/20* (2006.01)
(Continued)

(52) U.S. Cl.
CPC ..... *A47G 19/2272* (2013.01); *B65D 17/4014* (2018.01); *B65D 43/02* (2013.01);
(Continued)

(58) Field of Classification Search
CPC ..... B65D 17/00; B65D 17/16; B65D 17/161; B65D 17/165; B65D 17/166; B65D 43/00; B65D 43/02; B65D 43/14; B65D 43/16
(Continued)

(56) References Cited

U.S. PATENT DOCUMENTS 4,681,238 A 7/1987 Sanchez
6,216,904 B1 4/2001 Cagan
(Continued)

FOREIGN PATENT DOCUMENTS

EP 2354022 8/2011
FR 2781766 2/2000
(Continued)

OTHER PUBLICATIONS

English Abstract of EP2354022.
English Abstract of FR2781766.
English Abstract of FR2839950.

*Primary Examiner* — Steven A. Reynolds
*Assistant Examiner* — Javier A Pagan
(74) *Attorney, Agent, or Firm* — Dykema Gossett PLLC

(57) ABSTRACT

The invention relates to the lid (100) of a container, in particular a beverage can having at least one pour opening (103) penetrating the lid panel (101) which is reclosable by at least one closure member (120), where the at least one closure member (120) can be moved by an actuating element (103) from a closed position, in which the at least one pour opening (103) is closed, to an open position, in which the pour opening (103) is at least partially exposed, at least one planar seal element (130) is arranged between the lid panel (101) and the closure member (120), and at least one sealing area is provided at the closure member (120) which when closing the pour opening (103) coacts with the at least one
(Continued)

planar seal element (130), and where the at least one sealing area is formed as a seal ridge (121).

11 Claims, 6 Drawing Sheets

(51) Int. Cl.

| | |
|---|---|
| ***B65D 43/02*** | (2006.01) |
| ***B65D 43/16*** | (2006.01) |
| ***B65D 47/32*** | (2006.01) |
| ***B65D 53/00*** | (2006.01) |
| ***B65D 17/28*** | (2006.01) |

(52) U.S. Cl.
CPC ..... *B65D 43/16* (2013.01); *B65D 47/2018* (2013.01); *B65D 47/32* (2013.01); *B65D 53/00* (2013.01); *B65D 2205/02* (2013.01); *B65D 2251/0021* (2013.01); *B65D 2251/0081* (2013.01); *B65D 2543/00046* (2013.01)

(58) Field of Classification Search
USPC ..... 220/254.1, 254.2, 254.3
See application file for complete search history.

(56) References Cited

U.S. PATENT DOCUMENTS

| | | | | |
|---|---|---|---|---|
| 6,286,703 | B1 | 9/2001 | Monro | |
| 8,794,469 | B2 | 8/2014 | Bratsch | |
| 8,844,744 | B2 * | 9/2014 | Lucas | B65D 17/506 206/217 |
| 2011/0006062 | A1 * | 1/2011 | Bratsch | B65D 47/0866 220/265 |
| 2011/0315684 | A1 | 12/2011 | Bratsch | |
| 2013/0228586 | A1 | 9/2013 | Schandl | |
| 2013/0320013 | A1 | 12/2013 | Bratsch | |

FOREIGN PATENT DOCUMENTS

| | | |
|---|---|---|
| FR | 2839950 | 11/2003 |
| GB | 1389351 | 4/1975 |

* cited by examiner

LID OF A CONTAINER

BACKGROUND OF THE INVENTION

Field of the Invention

The invention relates to the lid of a container, in particular a beverage can, which includes at least one pour opening penetrating the lid panel which is reclosable by at least one closure member, where the at least one closure member can be moved by an actuating element from a closed position, in which at least one pouring opening is closed, to an open position, in which the pour opening is at least partially exposed.

The Prior Art

Containers of the type described above are produced, for example, as reclosable beverage cans. In a particularly advantageous embodiment of such cans, a pour opening is provided in the lid panel that is like the remainder of the can made of metal, typically made of aluminum or tinplate. This opening is closed by a closure member. This closure member is moved by an actuating element, for example, by a flap or a (rotary) slider from a closed position to an open position, whereby the pour opening is exposed for emptying the can, and can again be closed after the initial opening.

An essential requirement for reclosable beverage cans is their tightness even after repeated opening and closing of the pour opening. A closure member which is made of plastic and has an annular circumferential gas- and liquid-tight seal can be gathered, for example, from AT 507 950 A1 and AT 505 756 B1 of the applicant. However, such a closure member is due to its two-component structure (2 different plastics—a load-bearing hard component and a soft sealing component united in a single injection molded member) is expensive to manufacture. In addition, this technology allows only limited design options for the closure member because particular requirements regarding the plastic injection molding process need to be complied with in terms of parting planes, initial cast positions, wall thickness conditions, etc. It would be more cost-effective to realize the sealing function not by a two-component structure, but by a more readily available, and therefore more economical, planar sealing component from industrially more established standard production processes or semi-finished products.

WO 2011/124552 A1 discloses a container closure device in which a seal is disposed between a lid and a closure member. The contact of the closure member and the seal is there planar. The drawback there is that high contact pressures are needed to securely seal the container.

It is therefore an object of the invention to provide a lid for a reclosable container which ensures gas- and liquid-tight closure of the pour opening also after repeated reclosing and with prolonged storage of the container and which at the same time is cheap and easy to produce.

SUMMARY OF THE INVENTION

This object is satisfied by a lid of the aforementioned type in that at least one planar seal element is arranged between the lid panel and the closure member and at least one sealing area is provided at the closure member which during closure of the pour opening coacts with the at least one planar seal element. Planar seal elements, so-called liners, are known, for example, from closure caps of bottles. These are substantially flexible films preventing liquid and/or gas, in particular carbon dioxide, from escaping from the bottle. The at least one sealing area is according to the invention formed as a seal ridge. The pressure during closure exerted by the sealing area upon the planer seal element is increased over prior art due to the reduced contact surface, so that the seal ridge pushes into the planar seal element, thereby achieving an improved sealing effect with less force.

In the present invention, preferably at least one sealing area is provided at the closure member, in particular a seal ridge, which is in the closed position of the closure member pressed into the planar seal element and in this manner seals the pour opening and prevents the contents of the beverage can from leaking out.

In a particularly preferred embodiment of the invention, the at least one closure member and the planar seal element are disposed at the underside of the lid panel, where the at least one closure member during closure of the pour opening coacts with the planar seal element, and particularly preferably, the at least one sealing area is arranged at the surface of the closure member facing the underside of the lid panel.

In a further preferred embodiment of the invention, the closure member is pivotable from the open position to the closed position and from the closed position to the open position. Due to the pivotal motion, the at least one sealing area, in particular at least one seal ridge, is pressed substantially normally against the planar seal element when the closure member is moved to the closed position so that precisely defined sealing of the pour opening is obtained.

The at least one sealing area in a particularly preferred embodiment of the invention fully encloses the at least one pour opening when the closure member is in the closed position in order to achieve sufficient tightness of the reclosed beverage can, also when it is filled with carbonated beverages. In this, the sealing area runs at a distance from the edges of the pour opening, which, for example, has an elliptical shape. In a preferred embodiment, the sealing area, in particular a seal ridge, can be at an even (substantially uniform) distance from the edge of the pour opening, possibly also respectively with further openings. Since the at least one sealing area is pressed against the surface of the planar seal element when the closure member is in the closed position, the seal element must be made of at least partially elastic material. More preferably it is provided that the planar seal element is embodied as a film, in particular as a foam sheet or a rubber sheet.

In a particularly simple variant of the invention, the planar seal element covers the underside of the lid in its entirety, where only the area of the pour opening and possibly the openings for the arrangement of an actuating element remains uncovered.

Alternatively, the planar film is in a further embodiment of the invention smaller than the area of the lid and thereby covers the latter's underside only partially, where, however, the pour opening is again surrounded entirely by the planar seal element.

In the manufacture of the lid according to the invention, it is particularly preferably to provide that the planar seal element is attached to the underside of the lid of the container by inserting, bonding, printing, or casting. Furthermore, the planar seal element can be applied to the underside of the lid by compression molding, where the material of the planar seal element preferably comprises a thermoplastic elastomer. The thickness of the planar seal element can be in the range of 0.1 mm to 2 mm, preferably 0.2 mm to 1 mm.

Though the planar seal element in a further variant of the invention covers the lid panel practically in its entirety, it is not fixed over the entire surface to the lid, but only in small area spaced apart from each other.

Particularly cost-effective manufacture of the lid according to the invention is given when the closure device and/or the actuating element are made of plastic, where production can be achieved in large numbers in an easy and cost-effective manner by injection molding.

In a further development of the invention, the lid panel can comprise a ventilation opening and the closure member can be provided with a passage opening aligned with the ventilation opening, where the ventilation opening and/or the passage opening can be closed and opened with a peg in a fluid-tight manner.

In a preferred optional embodiment, the peg is tapered towards the ventilation opening. The ventilation opening or the passage opening, respectively, can therewith be closed by pressing in the peg.

The peg can be part of the actuating element or be provided separately, for example, as part of a pivotable flap.

The passage opening can comprise a seal ring, in particular a tube portion or an O-ring, for closing the ventilation opening and/or the passage opening with the peg in a fluid-tight manner.

Alternatively or in addition, the peg can on its outer side comprise a seal ring for fluid-tight closure of the ventilation opening and/or the passage opening with the peg, where the seal ring preferably comprises a tube portion or an O-ring.

According to a development, the passage opening can comprise a holding region, in particular a rivet button, for preventing the seal ring from slipping out, and/or the peg can comprise a holding region, in particular a rivet button, for preventing the seal ring from slipping off.

The lid according to the invention or one of its developments can be further developed in that the lid panel can further comprise an actuating element opening, where the planar seal element is preferably integrally formed, and where the planar seal element can enclose both the pour opening as well as the actuating element opening, and the pour opening as well as the actuating element opening can be uncovered, where in the presence of a ventilation opening, the ventilation opening can also be uncovered.

According to another development, the seal ridge can be formed as part of the closure member, the seal ridge can in particular be formed integrally with the closure member.

The seal ridge can have the cross-section of a V-shape, a V-shape with a flattened tip, a V-shape with a rounded tip, a rounded shape, in particular a semi-circular shape or a rectangular shape. These shapes are advantageous in that the seal ridge presses well into the planar seal element when the closure member is moved to the closed position, thereby achieving an effective seal, which is particularly relevant, for example, for carbonated beverages.

The size of the seal ridge is preferably such that a maximum height of the seal ridge is in the range of 0.2 mm to 1 mm and/or a maximum width of the seal ridge is in the range of 0.3 mm to 1 mm and/or in the case of a V-shaped seal ridge, the V-shape has an angle of 30° to 120° and/or in the case of a V-shape with a flattened tip, the width of the flat area is in the range of 0.05 mm to 0.2 mm and/or in the case of a V-shape with a rounded tip, the curvature radius of the rounded tip is in the range of 0.05 mm to 0.3 mm, and/or where the seal ridge is in the closed position pressed into the planar seal element by 0.1 mm to 1 mm.

If the lid panel comprises an actuating element opening, a seal ridge can each be provided for the pour opening, as well as for the actuating element opening, which encloses and seals the respective opening in the closed position. Alternatively, both openings can be enclosed by one seal ridge.

According to another further development, the planar seal element can on a peripheral edge of the planar seal element additionally comprise a thickening which is formed integrally with the planar seal element and with which an edge region of the lid is sealed relative to the container. The thickness/height of the planar seal element can be in the range of 0.1 mm to 2 mm, where the thickening has a height in the range of a factor by 1.1 to 5 of the thickness of the flat area, the thickening is therefore elevated by 10% to 400%.

BRIEF DESCRIPTION OF THE DRAWINGS

The invention will now be explained in more detail by way of non-restricting embodiments depicted in the accompanying drawings.

DETAILED DESCRIPTION

Figure 1:
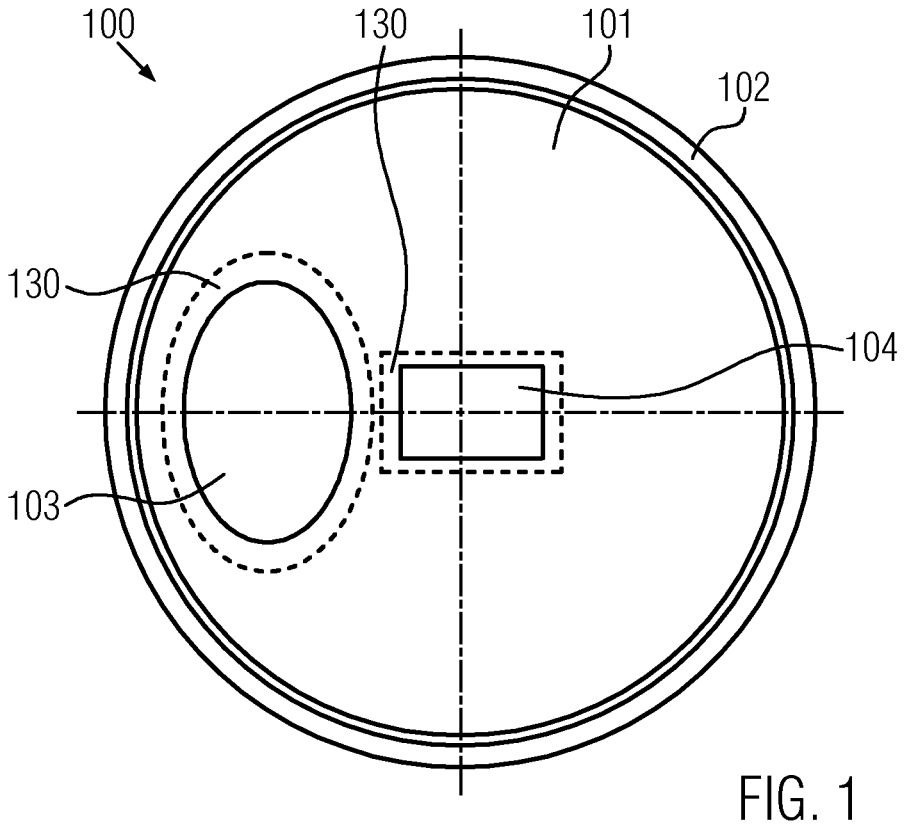
FIG. 1 shows a plan view of the lid according to the invention in a first embodiment.

FIG. 1 illustrates a lid 100 according to the invention in a top view, with a lid panel 101 and an edge region 102, where a pour opening 103 is provided that allows emptying the container—not shown—provided with the lid 100 according to the invention. Furthermore, an opening 104 is in this embodiment disposed substantially at the center of the lid panel for attaching an actuating element with the aid of which exposure of the pour opening 103 is effected. On the underside of the lid panel 101, a liner 130 is arranged acting as a planar seal element whose edges are shown in dashed lines. For example, an elastic film, a foam sheet or a multilayer film can be used as a liner 130. Alternatively, the liner 130 can be produced in a forming process, for example, by injection molding or injection compression molding. A further possibility is that the liner 130 is printed. Another embodiment has the liner be provided as an insert member which is incorporated into the lid. In this, for example, a peripheral bead can be provided on the inner edge of the lid preventing the liner from dropping out.

Figure 2A:
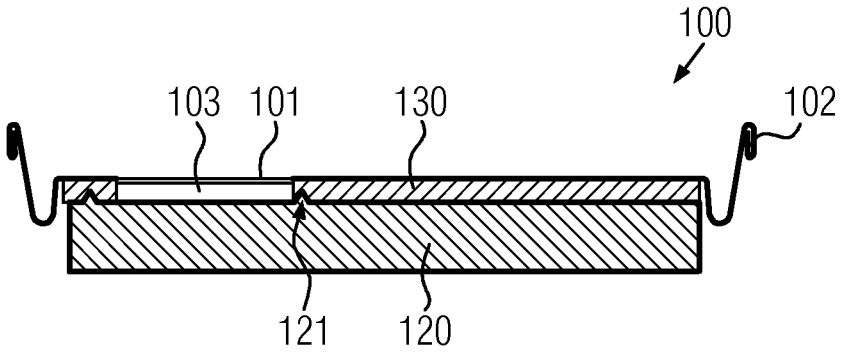
FIG. 2*a* shows a sectional view of a lid similar to FIG. 1 but when the liner covers the entire underside of the lid panel and a closure member is in closed position.
Figure 2B:
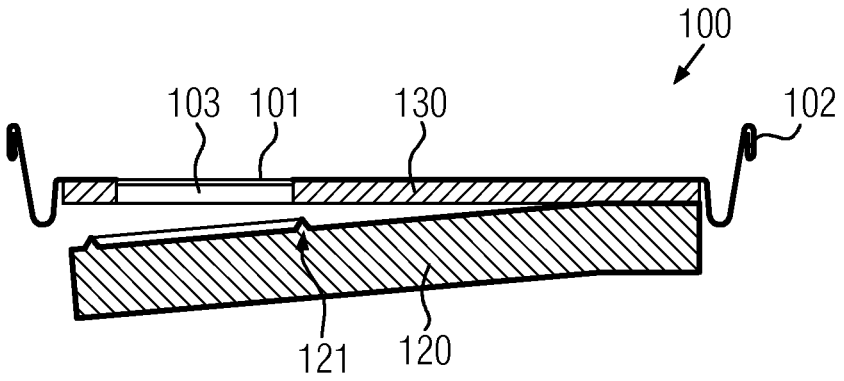
FIG. 2*b* shows the sectional view when the closure member is an open position.

In FIGS. 2*a* and 2*b*, the lid 100 is respectively shown in a sectional view, where in FIG. 2*a* a closure member 120 is disposed on the underside of the lid panel 101 and closes the pour opening 103. The planar seal element 130 is disposed on the underside of the lid panel 101 where the area of the pour opening 103 is left open.

If the pour opening 103 is now by exposed to the interior of the container by pivoting the closure member 120, as shown in FIG. 2*b*, then the contents of the container can be removed through the pour opening 103. Pivoting the closure member 120 using an actuating element is described, for example, in AT 505 756 B1 of the applicant. When reclosing the pour opening 103, the closure member 120 is again pivoted to the closed position shown in FIG. 2*a*, where a seal ridge 121 on the surface of the closure member 120 facing the lid underside is pressed into the planar seal element 130 to obtain the tightness required.

The embodiment of the invention shown in FIG. 1 has the planar seal element 130 arranged as a punch out member in the area of the pour opening 103 and opening 104 for the actuating element, as indicated in FIG. 1 by dashed lines, whereas the remaining areas on the underside of the lid panel 101 remain not covered by the planar seal element 130.

Figure 3:
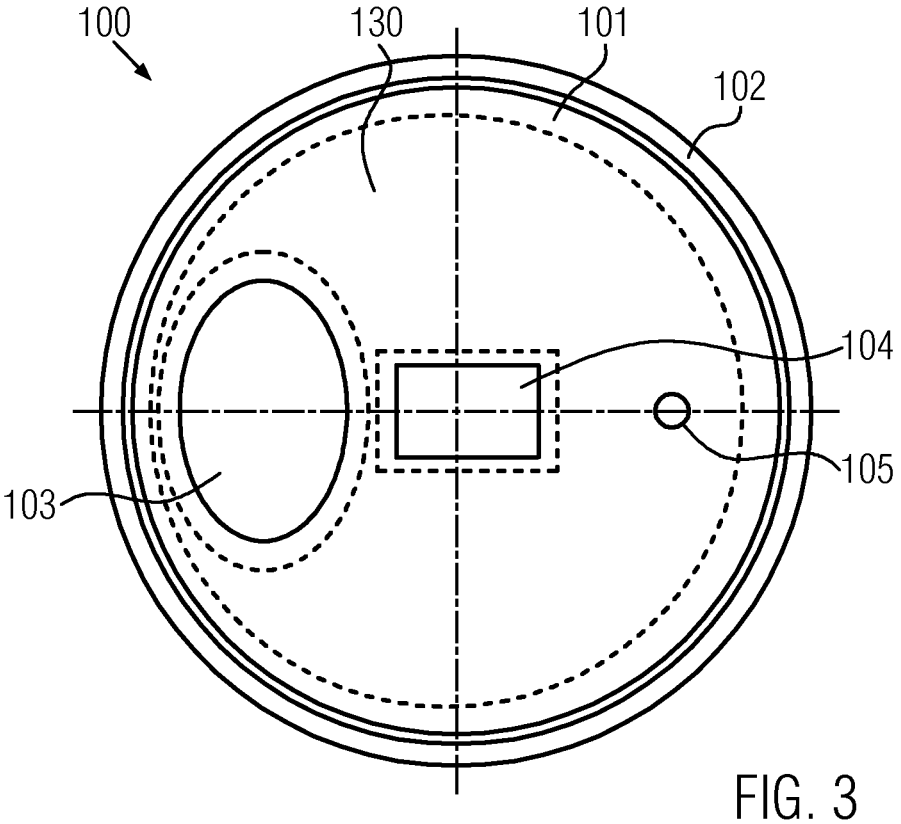
FIG. 3 shows a plan view of a further embodiment of the lid according to the invention, FIGS. 4*a,b,c* show a schematic representation of a peg according to the invention for tight closure of a ventilation opening, and FIGS. 5*a,b* show a sealed opening of the ventilation opening for receiving a peg.

In the embodiment of the lid 100 according to the invention shown in FIG. 3, however, the planar seal element 130 covers the underside of the lid panel 101 substantially in its entirety, only the pour opening 103 and the opening 104 of the actuating element are free. In addition, a ventilation opening 105 is presently provided in the lid panel 101 via which pressure can be equalized between the interior and exterior area of a container provided with the lid prior to opening the pour opening 103.

Figure 4A:
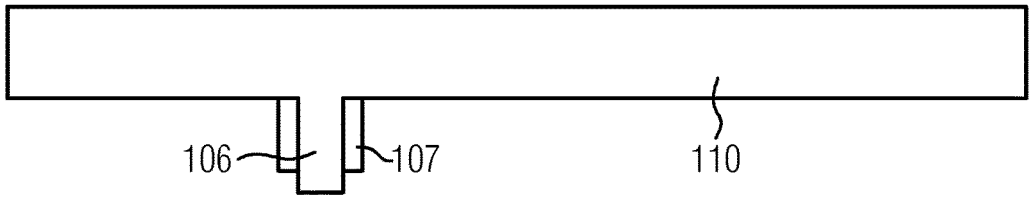
Figure 4B:
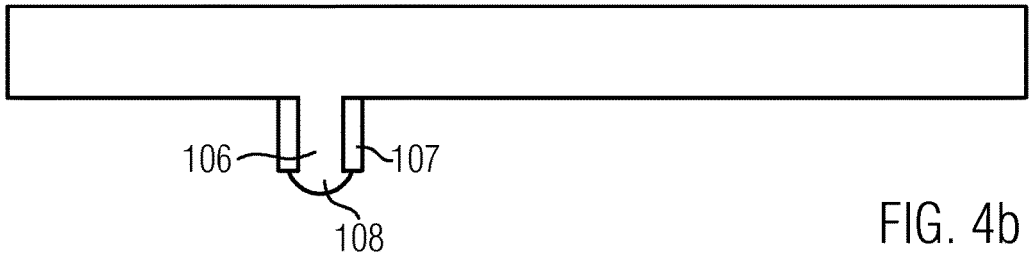
Figure 4C:
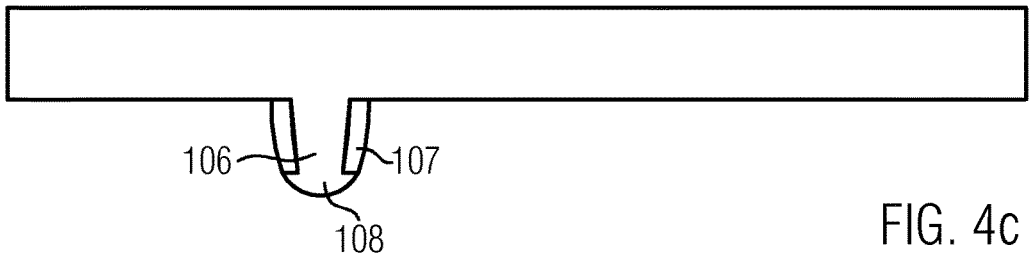

FIGS. 4*a*, 4*b* and 4*c* low embodiments according to the invention of a peg 106 for closing the ventilation opening 105 in the lid panel. This peg 106 can for instance be part of the actuating element 110 for actuating the closure member according to FIGS. 2*a* and 2*b*. An elastic seal ring 107 is in FIG. 4*a* provided on the peg 106 which in coaction with the ventilation opening or a complementary passage opening in the closure member can close the ventilation opening or the passage opening, respectively, in a fluid-tight manner, i.e., be impermeable to liquid and gas. The seal ring can, for example, be a suitably cut-off tube portion made of rubber or an O-ring made of elastic material. In FIG. 4*b*, a rivet button 108 is provided at the end of the peg 106 to prevent the seal ring from slipping off, in particular when opening the ventilation opening. In FIG. 4*c*, the peg 106 is conically shaped, namely, tapering towards the end of the peg facing the ventilation opening.

Figure 5A:
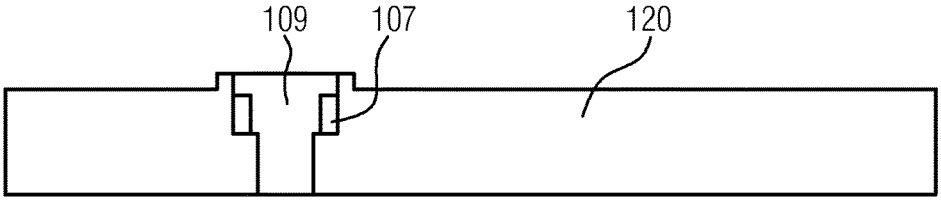
Figure 5B:
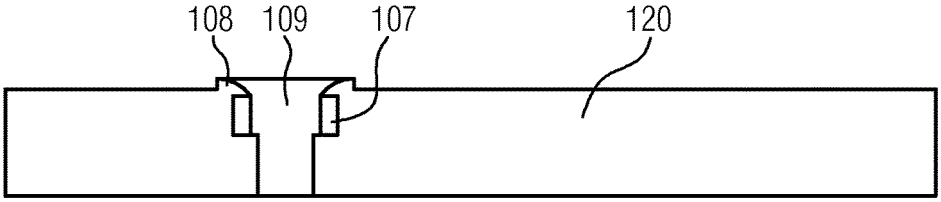

FIGS. 5*a* and 5*b* show a sealed passage opening 109 in the closure member 120 for receiving a peg. Tight closure of the ventilation opening is presently achieved by providing a seal ring 107 in the passage opening 109 of the closure member, where the passage opening 109 is aligned with the ventilation opening. Due to the coaction with a complementary peg (for example, with the peg 106 illustrated in FIGS. 4*a*-4*c*), the passage opening 109 or the ventilation opening, respectively, can be closed in a fluid-tight manner. In FIG. 5*a*, the seal ring 107 (or again preferably a tube portion or an O-ring) is only inserted into the opening 109. In FIG. 5*b*, a rivet button 108 is further provided at the closure member for securing the ring from slipping out.

Figure 6A:
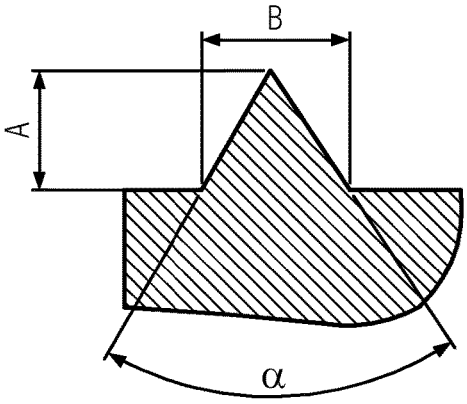
FIGS. 6*a,b,c,d* illustrate various embodiments of the seal ridge according to the invention.
Figure 6B:
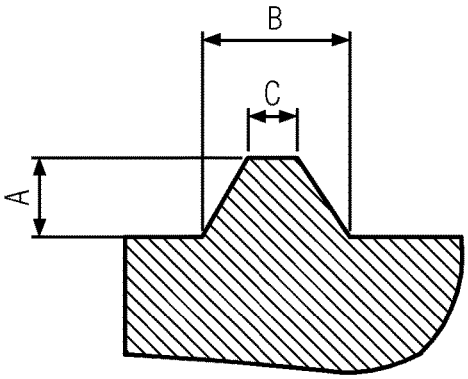
Figure 6C:
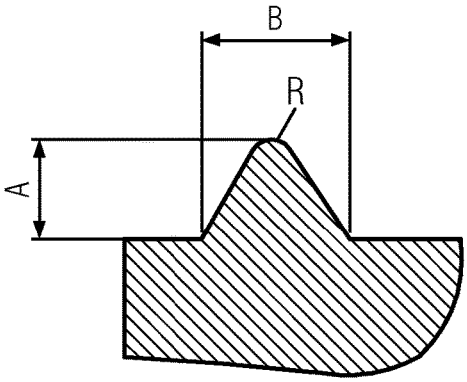
Figure 6D:
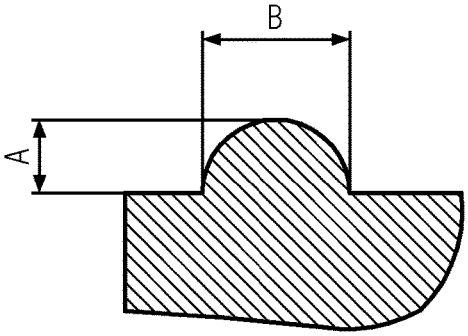

FIGS. 6*a*-6*d* illustrate various embodiments of the seal ridge according to FIG. 2, where the seal ridge is integrally formed with the closure member. FIG. 6*a* shows a V-shaped seal ridge. FIG. 6*b* shows a V-shaped seal ridge with a flattened tip. FIG. 6*c* shows a V-shaped seal ridge with a rounded tip. FIG. 6*d* shows a semi-circular seal ridge. The material which the seal ridge is made of is harder than the material which the flat seal element (e.g., thermoplastic elastomer) is made of, so that the seal ridge can press into the planar seal element for sealing.

The size of the seal ridge is in these embodiments such that a maximum height A of the seal ridge is in the range of 0.2 mm to 1 mm and/or a maximum width B of the seal ridge is in the range of 0.3 mm to 1 mm and/or in the case of a V-shaped seal ridge, the V-shape has an angle $\alpha$ of 30° to 120° and/or in the case of a V-shape with a flattened tip, the width C of the flat area is in the range of 0.05 mm to 0.2 mm and/or in the case of a V-shape with a rounded tip, the curvature radius R of the rounded tip is in the range of 0.05 mm to 0.3 mm. In this manner, the seal ridge is in the closed position of the closure member pressed into the planar seal element by 0.1 mm to 1 mm.

Figure 7A:
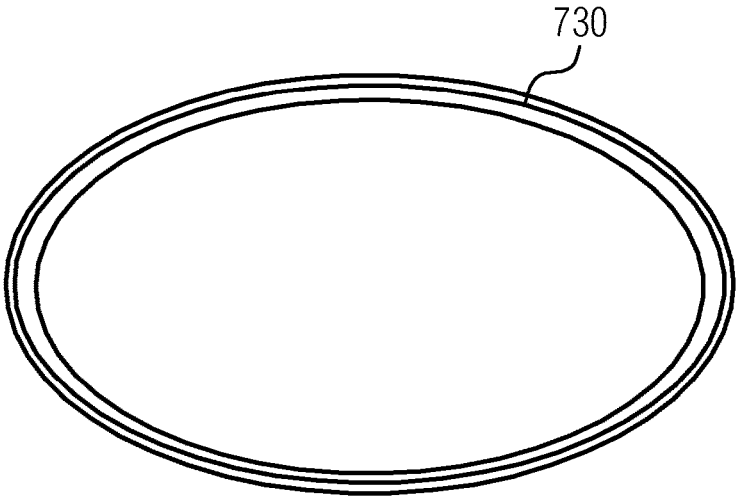
FIGS. 7*a,b* illustrate a planar seal element with a bead at its edge.
Figure 7B:
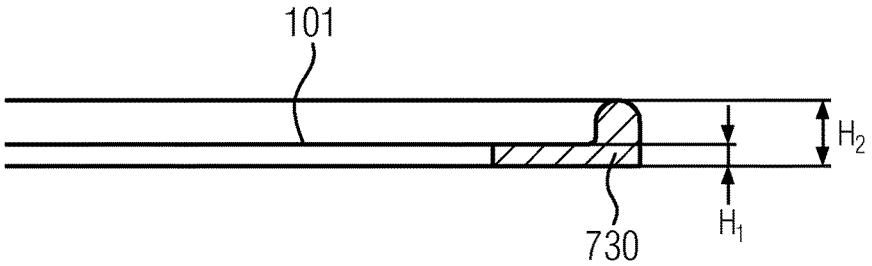

FIG. 7 illustrates a planar seal element 730 provided at a peripheral edge additionally comprising a thickening (a bead) 731 which is formed integrally with the planar seal element and with which an edge region (102) of the lid is sealed relative to the container/beverage can. In this embodiment, the planar seal element is annular. In the embodiment illustrated, the planar seal element is attached from below to the lid panel 101. The thickening/the bead projects beyond the edge of the closure member when the latter is in contact with the flat area of the seal element and additionally seals the edge of the closure member. The thickness/height H1 of the planar seal element can be in the range of 0.1 mm to 2 mm, where the thickening has a height H2 in the range of a factor by 1.1 to 5 of the thickness of the flat area, i.e. is larger by 10% to 400%.

It is understood that the present invention is not restricted to the above embodiments. In particular, the lid can be provided with further openings, for example, ventilation openings that are likewise sealed against leakage of the contents from the beverage can by coaction of the seal ridge of the closure member with the planar seal element. It can also be provided that the pour opening and/or ventilation opening is not sealed by a single seal ridge, but by several seal ridges running parallel to each other. Finally, the closure member illustrated in the figures is to be viewed as being non-restrictive, it does not necessarily need to be pivotable, it can also be movable substantially parallel to the lid panel, for example, along an axis, in order to be brought from a closed position to an open position and again returned. The sealing area can be realized in different ways at the closure member, it can in particular be formed as an elevated area with a variety of cross-sectional geometries.

The invention claimed is:

1. A lid for a container, said lid comprising:

a lid panel having an upper side and an underside and defining a pour opening extending there through from the upper side to the underside, a planar seal element covering the entire underside of the lid panel except for said pour opening, and a closure member attached to the underside of the lid panel and movable toward and away from the underside of the lid panel to close and open the pour opening, said closure member having a generally flat upper surface and an endless seal ridge which extends away from the upper surface for projecting into the planar seal element a distance of 0.1 to 1 mm to close and seal the pour opening when the closure member is moved against the planar seal element.

2. The lid according to claim 1, wherein said closure member is pivotable relative to the lid panel.

3. The lid according to claim 1, wherein said planar seal element comprises a foam or rubber sheet.

4. The lid according to claim 1, wherein said closure member consists of plastic.

5. The lid according to claim 1, where said lid panel comprises a ventilation opening and said closure member is provided with a passage opening aligned with said ventilation opening, where said ventilation opening and/or said passage opening can be closed and opened with a peg in a fluid-tight manner.

6. The lid according to claim 1, where said lid panel further comprises an actuating element opening, where said planar seal element is integrally formed, and where said planar seal element encloses both said pour opening as well as said actuating element opening, and said pour opening as well as said actuating element opening are uncovered.

7. The lid according to claim 6, where a seal ridge is respectively provided for said pour opening as well as for said actuating element opening and encloses and seals the respective opening in said closed position.

8. The lid according to claim 1, wherein said seal ridge is formed integrally as part of said closure member.

9. The lid according to claim 1, wherein said seal ridge has a cross-section configured as a V-shape, a V-shape with a flattened tip, a V-shape with a rounded tip, a rounded shape, a semi-circular shape or a rectangular shape.

10. The lid according to claim 9, wherein a maximum height of said seal ridge is in the range of 0.2 mm to 1 mm and/or a maximum width of said seal ridge is in the range of 0.3 mm to 1 mm and/or in the case of a V-shaped seal ridge, the V-shape has an angle ($\alpha$) of 30° to 120° and/or in the case of a V-shape with a flattened tip, the width of the flat area is in the range of 0.05 mm to 0.2 mm and/or in the case of a V-shape with a rounded tip, the curvature radius of the rounded tip is in the range of 0.05 mm to 0.3 mm.

11. The lid according to claim 1, wherein said planar seal element comprises a thickening on a peripheral edge for sealing relative to a container.

* * * * *